United States Patent [19]

Wu

[11] 4,216,666

[45] Aug. 12, 1980

[54] METHOD OF RELIEVING STRESS IN EXTRUDED SECTIONS

[75] Inventor: Hsiao Wu, Rockford, Mich.

[73] Assignee: Extruded Metals, Belding, Mich.

[21] Appl. No.: 943,017

[22] Filed: Sep. 18, 1978

[51] Int. Cl.[3] ..... B21C 19/00; B21C 23/08; B21C 1/20; B21D 3/05

[52] U.S. Cl. ..... 72/256; 72/274; 72/275; 72/160; 72/161; 72/700

[58] Field of Search ..... 72/274, 256, 183, 275, 72/278, 161, 164, 160, 163, 166, 276, 700, 165, 286

[56] References Cited

U.S. PATENT DOCUMENTS

| | | | |
|---|---|---|---|
| 1,271,703 | 7/1918 | Guibert | 72/161 |
| 1,649,704 | 11/1932 | Kelley et al. | 72/161 |
| 2,126,453 | 8/1938 | Criley et al. | 72/274 |
| 2,310,916 | 2/1943 | Gaines, 3rd et al. | 72/161 |
| 2,462,396 | 2/1949 | Heller | 72/165 X |
| 2,963,070 | 12/1960 | Maust | 72/163 |
| 3,031,750 | 5/1962 | Von Planck | 72/161 |
| 3,157,274 | 11/1964 | Kyle et al. | 72/274 |
| 3,163,285 | 12/1964 | Nachtman | 72/264 |
| 3,299,687 | 1/1967 | Kneip, Jr. et al. | 72/278 |
| 3,867,825 | 2/1975 | Striepens et al. | 72/161 |

*Primary Examiner*—Lowell A. Larson
*Attorney, Agent, or Firm*—Cullen, Sloman, Cantor, Grauer, Scott & Rutherford

[57] ABSTRACT

A method for continuously relieving residual stresses in hot extruded then cold drawn brass sections, particularly leaded yellow brass. In the disclosed method, the residual stress is localized near the surface of the brass section during cold draw by limiting the percentage reduction in cross-sectional area for the section as it passes through a smaller angle cold draw die. This is accomplished by using a cold draw die having a relatively small attack angle which minimizes the stress at the center of the brass section and localizes the residual stress to an area near the surface of the section. The configured extruded, cold drawn rod is mechanically worked by passing it through mechanical benders which are set to alternatively bend the rod out of alignment first relative to a horizontal longitudinal axis and then relative to a vertical longitudinal axis. The mechanical working of the extruded cold drawn section, according to the present invention, relieves residual stress in the requirement for annealing or heat treatment. The final step in the process is to straighten the section by passing it through a series of rollers in a conventional manner. In an alternative embodiment, the method taught by the present invention may be practiced by two in-line straighteners wherein the first straightener is purposely set out of alignment to work the metal rod and reduce residual stress, and the second straightener is set in a normal manner to restraighten the section to a customer's specifications.

1 Claim, 1 Drawing Figure

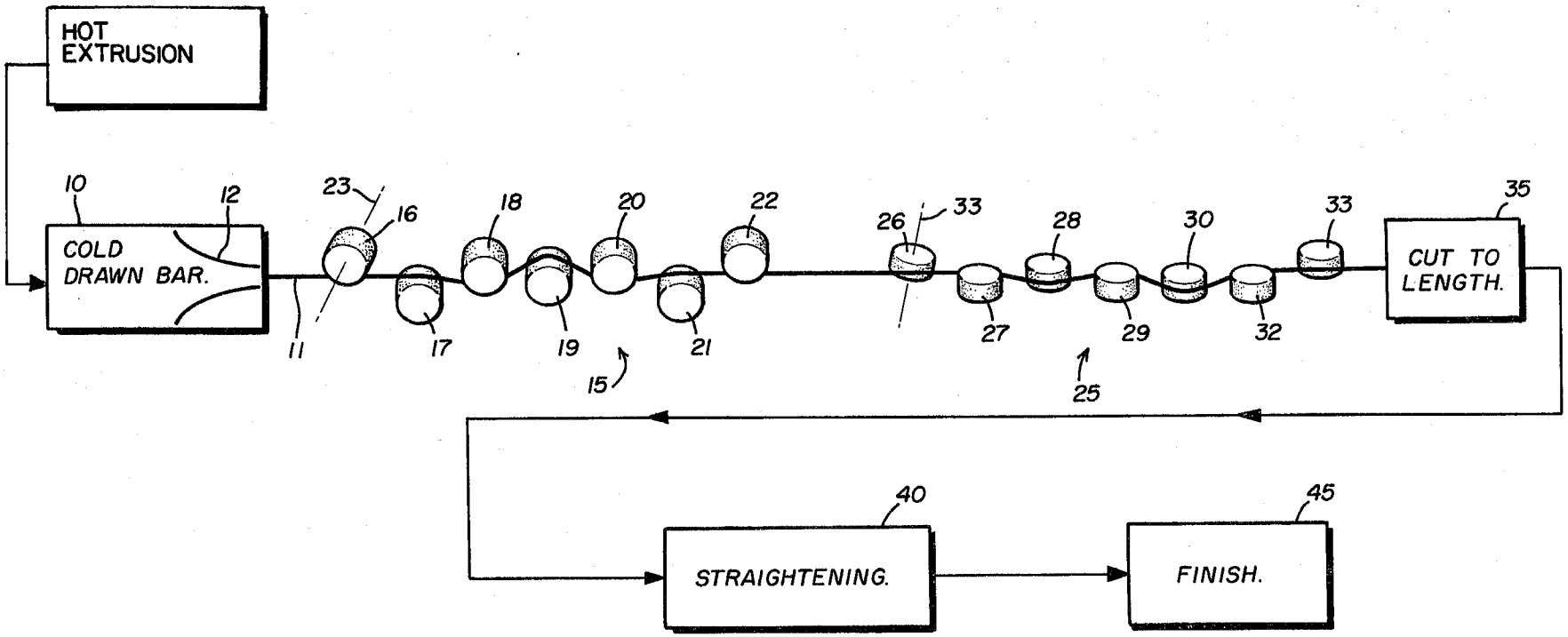
HOT EXTRUSION
COLD DRAWN BAR.
CUT TO LENGTH.
STRAIGHTENING.
FINISH.
10
11
12
15
16
17
18
19
20
21
22
23
25
26
27
28
29
30
32
33
33
35
40
45

METHOD OF RELIEVING STRESS IN EXTRUDED SECTIONS

BACKGROUND OF THE INVENTION

1. Field of the Invention

The invention relates generally to relieving residual stress in strain hardened metals, and more particularly to a method of localizing the stress near the surface of an extruded, cold drawn section and alternatively bending the section out of alignment first relative to a horizontal longitudinal axis and then relative to a vertical longitudinal axis, thereby flexing the cold drawn section beyond its elastic limit for the purpose of relieving residual stress.

2. Statement of the Prior Art

It is well known in metallurgy that metals have improved physical properties brought about in an operation of cold drawing the metal, which has the form of a rod, bar, or the like, through a cold draw die to effect a change in the cross-sectional area of the metal form.

A metal subjected to cold working or plastic deformation, as it is sometimes referred to, is said to be "strain hardened" in response to the cold working, and it possesses physical characteristics after the plastic deformation process that are commercially desirable such as improved machinability, improved resistance to wear and improved surface finish or dimensional tolerance.

The effects of cold working or plastic deformation are not all desirable because cold working metal also results in the development of internal elastic stresses in the metal, generally referred to as residual stresses. During plastic deformation, the registry between adjacent planes of atoms is disturbed resulting in the formation of dislocations. The disturbance to the atoms and crystal lattice during plastic deformation causes an increase in the stored strain energy in the metal and residual stresses. Various techniques have been devised to relieve the residual stresses arising as a consequence of strain hardening the metal.

One mechanical treatment technique, shot peening, has been used to modify the residual stress pattern and to introduce some compressive stresses in the peened surface. For example, U.S. Pat. No. 4,084,585 discloses a prior art method for increasing the resistance to brittle fractures in metals by shot peening or surface rolling the metal workpiece to increase the fatigue strength.

A mechanical treatment limited to sheet metal has been used in U.S. Pat. No. 1,271,703 which discloses a method of eliminating strain marks from sheet metal articles by transversely flexing the metal using parallel rolls of a straightening apparatus. U.S. Pat. Nos. 1,649,704 and 1,649,705 disclose another apparatus for removing surface irregularities in sheet metal by first working the sheet between one set of cooperating rolls positioned to flex and bend the sheet of metal and then deflecting the sheet by an auxiliary bending roll to give the sheet an initial bending greater than that imparted to it by the set of cooperating rolls.

Another mechanical treatment for circular section steel bars used as concrete structural members, has been to roll the bars through between circular plates. As disclosed in U.S. Pat. No. 3,031,750, the bar is cold worked by bending successive portions of the bar transversely back and forth and simultaneously rotating the bar about its longitudinal axis.

The most common method of stress relief is stress relieving annealing, which requires heating the metal to a temperature below the recrystallization temperature of the metal for a period of time wherein readjustment of the crystal structure relaxes the residual stresses. An undesirable side effect of annealing is oxidation on the surface of the metal which is commonly removed by dipping the metal in a diluted sulfuric acid pickling solution having sodium dichromate. From an environmental standpoint, the chromic acid dip is very undesirable because it pollutes the water with sodium dichromate which is a very toxic substance.

Another problem with the prior art devices, such as mechanical straighteners, which advertise a reduction of residual stress, is that the actual reduction in residual stress is insufficient. A standard test for residual stress of free cutting brass is the mercurious nitrate test, ASTM B 154 wherein the cold draw extrusion is immersed in a solution of mercurious nitrate and nitric acid following degreasing, pickling, etc. The residual stress in the rod becomes visible in a series of cracks or crazing. A hot extruded cold draw part that is mechanically straightened and tested using the mercurious nitrate test will still show a series of stress cracks flowing in the direction of the cold draw. Thus, conventional mechanical straightening does not completely remove the residual stress.

The various heat and mechanical treatments taught by the prior art are unacceptable in terms of equipment cost, labor, environmental impact, and actual stress relief. The method of the present invention solves substantially all of the problems of the prior art by providing a continuous process that relieves residual stress using a unique mechanical treatment.

SUMMARY OF THE INVENTION

The present invention relieves residual stresses introduced into metals which tend to strain harden in response to plastic deformation by utilizing plural successive steps not found in the prior art. The first step localizes the stress near the surface of the extruded section by limiting the percentage reduction in cross-sectional area for the section as it passes through a smaller angle cold draw die. The second step requires mechanical working of the section by passing it through mechanical benders which are set to alternatively bend the rod out of alignment first relative to a horizontal longitudinal axis and then relative to a vertical longitudinal axis. The final step in the process is to straighten the section by passing it through a series of rollers in a conventional manner.

The inventive concepts herein are illustrated by reference to the processing of extruded then cold drawn sections, particularly leaded yellow brass, wherein the section is extruded by heating a brass billet, and using a conventional ram to extrude the hot billet through a die. The extruded brass section is cold drawn into a final configuration by pulling the section through a second die to effect a change in cross-sectional area. The method can be used for various extruded section configurations including rod, bar, and extruded cold draw shapes, such as square, hexagonal, and octagonal. It will be understood that the inventive concepts are applicable also to the processing of other metals such as aluminum alloys, copper base alloys, titanium base alloys and the alloys which strain harden upon plastic deformation.

The disclosed method of the present invention has two steps to achieve the desired stress relieving, and the first step includes the use of a cold draw die having a tapered bearing portion or entrance angle of between 8 and 12 degrees which limits the percent area reduction of the metal to 18% or less and localizes the residual stresses near the surface of the metal section. At present, brass extruders use dies having an attack angle of between 12 and 16 degrees, and it is through this portion of the die wherein the major reduction in cross-sectional area occurs. The prior art teaches localizing stresses near the surface of extruded sections, but not as part of a method for stress relief wherein the stresses are intentionally localized at the surface and then relieved by a subsequent step of mechanical working.

The second step of the present method mechanically works the extruded section by passing the rod through mechanical benders which are set to alternatively bend the rod out of alignment first relative to a horizontal longitudinal axis and then relative to a vertical longitudinal axis. The rollers of the benders are set out of longitudinal alignment to alternatively flex the extruded section beyond its elastic limit. During the bending cycle, the convex surface of the section is placed in tension and the opposed concave surface is placed in compression. Prior to the mechanical working step, the distribution of the tensile residual stresses increases approaching the surface of the section, as previously discussed. By repeatedly bending the section, more mechanical work is done on the high stress region of the section, and consequently, the stress is substantially reduced or cancelled entirely.

The final step in the process is to straighten the extruded section by passing it through a series of rollers in a conventional manner.

The method may be practiced in an alternative embodiment by using two in-line straighteners. The first straightener is purposely set out of alignment to work the extruded section and eliminate residual stress. The second straightener is set in the normal manner to restraighten the section to the customer specification.

The present method has several important advantages over conventional annealing. The method is continuous, that is, the extruded section is mechanically worked and then immediately straightened in a continuous line. It is less expensive and eliminates the requirement for a furnace used in conventional annealing. Further, the method has environmental advantages in that it eliminates the requirement for a chromic acid dip thereby minimizing water pollution.

Other advantages and meritorious features of the present invention will be more fully understood from the following detailed description of the preferred embodiment and the appended claims.

DESCRIPTION OF THE PREFERRED EMBODIMENT

As can be seen most clearly by reference to the drawing, the mechanical stress relieving system of the present invention includes a cold draw die 10, a first mechanical bending device 15, a second mechanical bending device 25, a cutter 35, a mechanical straightener 40, and a finisher 45.

The present method can be used for various extruded section configurations including rod, bar, extruded cold draw shapes, etc., and the method is applicable to the processing of various metals which strain harden upon plastic deformation.

The inventive concepts herein are illustrated by reference to the processing of hot extruded and cold drawn sections, particularly leaded yellow brass. As is conventional, a brass billet is heated and extruded through a die using a ram. The extruded brass section is cold drawn into a final configuration, such as rod 11 shown in the drawing, by pulling it through a second die 10 to effect a change in cross-sectional area.

The method of the present invention has two steps to achieve the desired stress relieving, and the first step includes the use of cold draw die 10 which has a tapered bearing portion 12 of between 8 and 12 degrees. The small attack angle of the tapered bearing 12 limits the percentage reduction in cross-sectional area in rod 11 to approximately 15%, or less than 18%, as it passes through the cold draw die 10. Consequently, the residual tensile stresses are minimized at the center of the brass section 11 and localized to an area at or near the surface of the section.

The next step of the method includes mechanical bending of the extruded section 11 by passing it through mechanical benders 15 and 25 which are set to alternatively bend the section out of alignment first relative to a horizontal longitudinal axis and then relative to a vertical longitudinal axis. The rollers 16–22 of the mechanical bender 15 are set out of longitudinal alignment with respect to each other to alternatively flex the extruded section 11 beyond its elastic limit about a horizontal longitudinal axis such as 23. Rollers 26–32 of mechanical bender 25 are set out of alignment with respect to each other to alternatively flex the extruded section 11 beyond its elastic limit about a vertical longitudinal axis such as 33. By repeatedly bending the section 11, more mechanical work is done on the high stress region, at or near the surface of the rod 11, and consequently, the localized stress is substantially reduced or cancelled entirely.

The method of the present invention is continuous, that is, the extruded section 11 is mechanically worked and then immediately straightened in a continuous line. After the section 11 leaves the second mechanical bender 25, it passes through a cutter 35 where it is cut into lengths according to a customer's specification. The cut to length sections pass through a mechanical straightener 40, as is conventional, and finally, they are passed through a finisher 45.

In an alternative embodiment of the method taught by the present invention, two in-line straighteners may be used wherein the first straightener is purposely set out of alignment to work the extruded metal section and eliminate residual stress, and the second straightener is set in a normal manner to restraighten the section to a customer's specifications.

The disclosed method has several important advantages over conventional annealing in that it is continuous and does not require the furnace or chromic acid dip of the annealing process. Thus, the method has important advantages from an environmental standpoint.

It will be apparent to those skilled in the art that the foregoing disclosure is exemplary in nature rather than limiting, the invention being limited only by the appended claims.

I claim:

1. A method for continuously relieving stresses in hot extruded then cold drawn leaded yellow brass sections comprising the steps of:

(a) extruding hot brass through a first die to form an extruded section;

(b) cold drawing said extruded section through a second die into a finally configured section including localizing the residual tensile stresses to an area near the surface of said section as it is being cold drawn through said second die by limiting the percentage cross-sectional area reduction in said section to 18 percent or less as it is being cold drawn through said second die, and minimizing the residual stress at the center of said section and localizing the stress to an area near the surface of said section by providing a tapered bearing portion for said second die having an attack angle of between eight and twelve degrees;

(c) mechanically bending said section relative to a horizontal longitudinal axis and relative to a vertical longitudinal axis including alternatively bending said section out of alignment by using a first mechanical bender having rollers set out of longitudinal alignment to flex said section beyond its elastic limit relative to a horizontal longitudinal axis and a second mechanical bender having rollers set out of longitudinal alignment to bend said section beyond its elastic limit relative to a vertical longitudinal axis; and (d) straightening said section by passing it through a series of rollers of an in-line mechanical straightener.

* * * * *